United States Patent [19]

Shultz et al.

[11] Patent Number: 4,857,011

[45] Date of Patent: Aug. 15, 1989

[54] FIELD REPAIRABLE CABLE CONNECTOR

[75] Inventors: Preston D. Shultz; William Owen, both of Canyon Lake, Calif.

[73] Assignee: Wyle Laboratories, El Segundo, Calif.

[21] Appl. No.: 154,120

[22] Filed: Feb. 8, 1988

[51] Int. Cl.[4] ..... H01R 13/52; H01R 13/58

[52] U.S. Cl. ..... 439/469; 29/857; 439/279

[58] Field of Search ..... 439/271, 273, 278, 279, 439/460, 462, 469, 677, 678; 29/838, 857

[56] References Cited

U.S. PATENT DOCUMENTS 3,402,382 9/1968 Detar ..... 439/469

FOREIGN PATENT DOCUMENTS 2347971 4/1974 Fed. Rep. of Germany ..... 439/271

3509344 9/1986 Fed. Rep. of Germany ..... 439/678

*Primary Examiner*—Eugene F. Desmond

*Attorney, Agent, or Firm*—Freilich Hornbaker Rosen & Fernandez

[57] ABSTRACT

A connector is described, of the type which is attached to the outer end of a cable and used at an airport to supply power to aircraft on the ground, which facilitates installation and repair of the connector in the field. The connector includes a rubber housing 20 with contact-passing holes 24–29 at the front end and an opening 34 at the rear. The connector also includes a plastic tray 36 which holds the contacts 51–56 and the end portion of the cable where the wires 71–76 of the cable connect to the contacts. After connections are made at the tray, the tray is slid forwardly through the rear end of the housing deep into the housing, with the front of the contacts aligned with the holes at the front of the housing, and a grommet 86 is emplaced to seal the rear of the housing.

9 Claims, 2 Drawing Sheets

FIELD REPAIRABLE CABLE CONNECTOR

BACKGROUND OF THE INVENTION

Electrical power is generally supplied to airliners and other aircraft parked on the ground at an airport, through long cables having a connector at their outer ends that connect to the aircraft. The connectors are subjected to rough handling and require occassional repair or replacement, which is preferably accomplished in the field. The connector must be substantially waterproof and make a substantially waterproof coupling to the cable, and enable good electrical connections to be made between several wires of the cable and each of several corresponding contacts of the connector. One type of connector is described in U.S. Pat. No. 2,955,275 wherein each wire is attached to a rear portion of a contact installed in the rear of a housing. A front portion of the contact is installed in the front of the housing and attached to the rear portion. The combinations of wires and contacts are enclosed within a split rear housing portion. Such an arrangement has the disadvantages that it requires a housing portion split along most of its length which is difficult to reliably seal watertightly, it seals only one row of contact-wire combinations, and does not enable provisions for strain relief of the wires immediately behind their connection to the contacts. Also, the use of contacts having rear portions joined by a screw, can lead to high resistance and other problems if the screw loosens as a result of vibrations and temperature changes. A connector which facilitated the in-field connection of the multiple wires of a sheathed cable, in a reliable watertight housing, which enabled a plurality of rows of single-piece contacts to be reliably sealed in place and which enabled strain relief to be provided for within the watertight housing, would be of considerable value.

SUMMARY OF THE INVENTION

In accordance with one embodiment of the present invention, a connector is provided which facilitates the in-field connection and mounting of the multiple wires of a sheathed cable to multiple connector contacts, and the mounting of the contacts in a highly reliable watetight housing. The connector includes a housing of insulative material with a front end forming contact-receiving holes and a rear forming a tray-passing hole. A tray of insulative material has an open rear end through which a sheathed cable can pass and where the cable can be clamped in place, and a front end with a contact retainer portion which can securely hold the contacts. The wires can be connected to the contact, the contacts installed in a retainer portion of the tray with any strain relief also occuring within the tray, and the sheathed cable clamped to the rear of the tray. The tray can then be slid forwardly through the rear end of the housing until the contacts lie at the holes in the front of the housing, a grommet then sealing the rear of the housing to the sheathed cable.

The novel features of the invention are set forth with particularity in the appended claims. The invention will be best understood from the following description when read in conjunction with the accompanying drawings.

DESCRIPTION OF THE PREFERRED EMBODIMENT

Figures 1, 2:
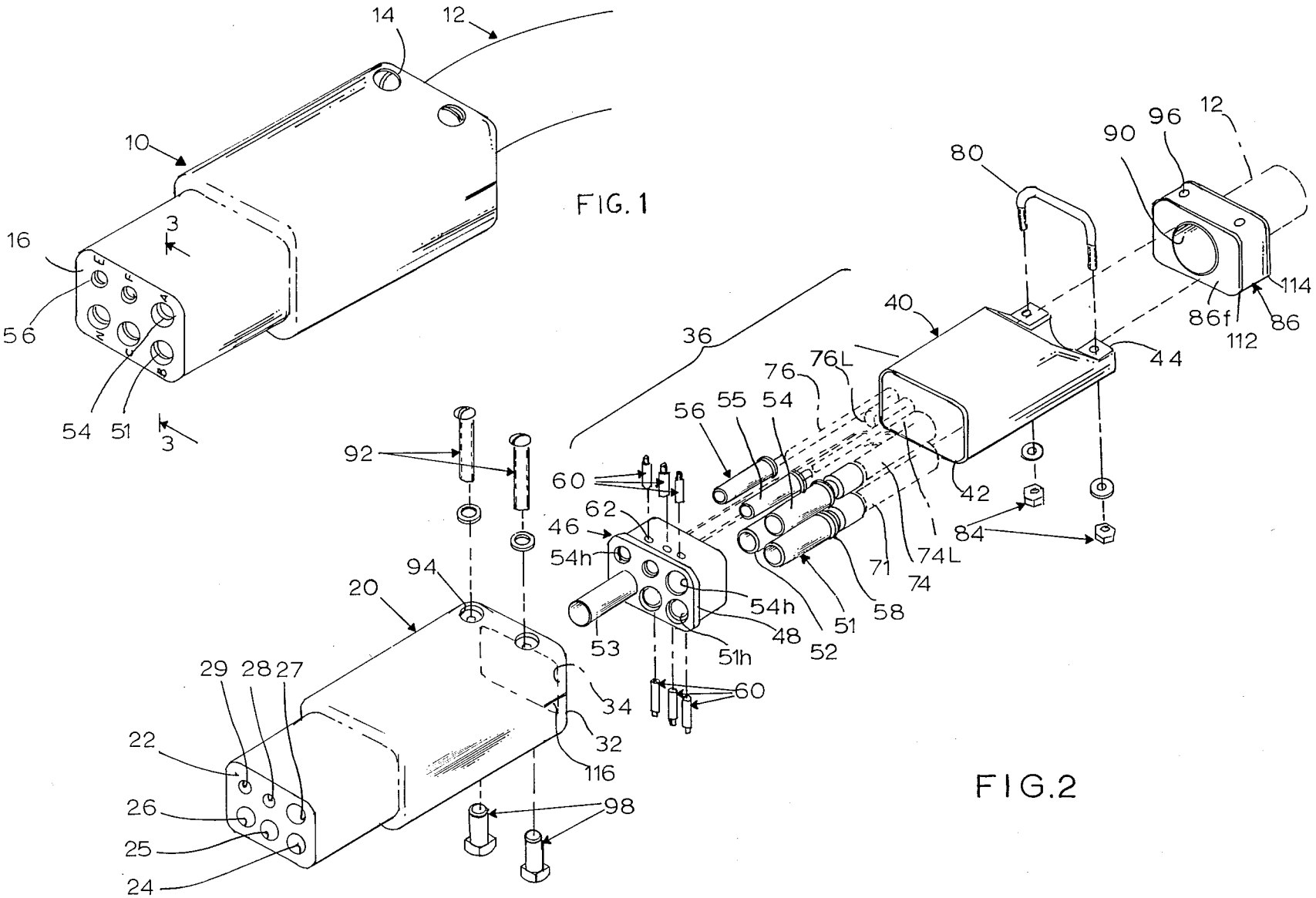
FIG. 1 is a perspective view of a connector of the present invention shown in a fully assembled configuration.
FIG. 2 is an exploded perspective view of the connector of FIG. 1, with the cable being shown in phantom lines.

FIG. 1 illustrates a connector 10 coupled to a cable 12 extending from the rear 14 of the connector. The front 16 of the connector forms a plug with female contacts 51–56, and is designed to be plugged into a receptacle on an aircraft parked at an airport, to supply electrical power to the aircraft while it is stationary on the ground. The connector 10 is subject to wear and damage, as it may often be dropped onto the ground and allowed to be pulled along the ground as the cable is wound up after use. The connector must operate reliably in rainy weather, where it must strongly resist the entrance of water that could corrode or even short circuit the electrical conductors that are carrying considerable current at considerable voltage levels.

As shown in FIG. 2, the connector includes a housing 20 formed of elastomeric insulative material such as soft rubber. The front end 22 of the housing forms six contact-receiving holes 24–29, where pin or male contacts enter the connector, and has a rear end 32 with a substantially rectangular tray-passing hole 34 through which the cable 24 can extend. A tray 36 of substantially the same rectangular cross-section as hole 34 is provided which includes a tray frame 40 of rigid insulative material such as a rigid plastic, with open front and rear ends 42, 44. The tray also includes a contact retainer 46 forming the front portion of the tray, where the contacts 51–55 are mounted, which are to lie alinged with the contact-receiving holes 24–29 of the housing. The contact retainer has a front plate 48 with contact locating holes **51*h*–56*h* for receiving the contacts and a rearward portion that can slide into the tray frame. Each of the contacts such as 51 has a flange 58 that can abut a shoulder 59 at a rear face of the front plate 48 of the retainer. Pins 60 can be installed in pin-receiving holes 62 of the retainer behind the flanges 58** of the contact to securely hold the contacts in place in the retainer. Each contact is a single-piece, or unitary, element, with its front end (where it mates with another contact) and its rear end (where is connects to a wire of the cable) being integral.

The cable 12 has six wires 71–75 that connect to rearward portions of the contacts 51–55. Each of the wires is preferably formed with a looped or folded-over portion such as 76L for strain relief. The tray includes a clamp 80 which can securely clamp to the sheathed cable 12 to avoid relative movement of the cable to the tray. The clamp is fastened in position with nuts 84 that attach to threaded ends of the U-shaped clamp. A rear seal grommet 86 has a hole 90 for closely passing the cable 12, and the grommet itself fits closely within the rear of the housing in the tray-passing hole 34 thereof. The grommet is secured in position by screws 92 that pass through holes 94 in the rear of the housing and holes 96 in the grommets, and which are secured to tubular nuts 98.

The attachment of the cable wires such as 76 to the contacts such as 56, the mounting of the contacts in the retainer 46 of the tray, the folding of the wires in strain relief folds such as 76L, and the clamping of the cable to the rear of the tray, all occur outside of the housing 20. The tray securely holds the contact, the wires, and the cable, although the tray is an opens structure which does not provide watertight sealing. After the tray with the contacts and wire are assembled, the tray is slid forwardly through the tray-receiving hole 34 in the housing, until the entire tray is fully in and enclosed within the housing, with the contacts aligned with the contact-receiving holes at the front of the housing. The grommet 86 is then installed to seal the housing, with the tray and the contacts and cable securely mounted therewithin and the front **86*f* of the grommet abutting the rear 44** of the tray frame. Thus, the multiple contacts and wires are slid as a single unit into the housing, so the housing can be formed as a unitary watertight element with a minimum of holes to assure reliable watertight sealing of its contents.

Figure 3:
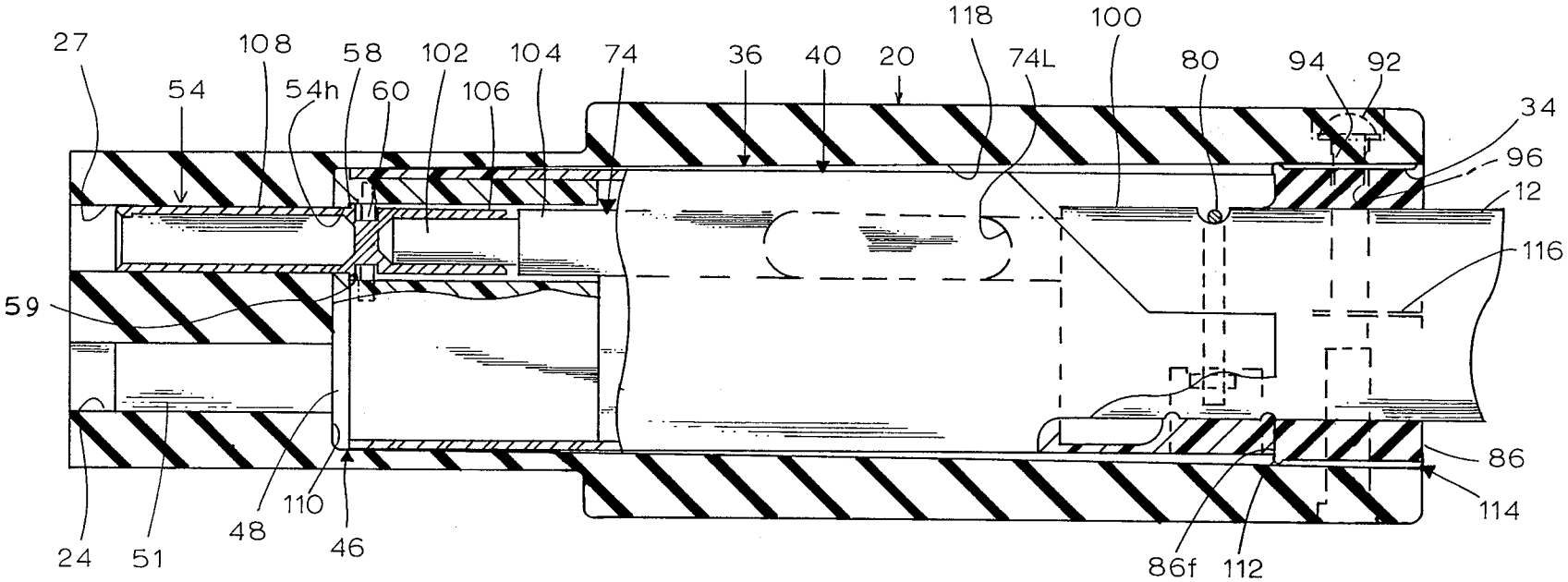
FIG. 3 is a view taken on the line 3—3 of FIG. 1.

As also shown in FIG. 3, the coupling of a sheathed cable 12 to the connector is accomplished first by stripping away the sheath 100 of the cable up to the location shown to leave the wires such as 74 individually accessible. The grommet 86 and tray frame 40 are then slipped onto the cable. Each wire such as 74 includes a conductor 102 and an insulator 104. The conductor 102 is inserted into a rearward portion 106 of a contact such as 54 and the contact is crimped around the conductor to hold it in place. A forward portion 108 of the contact is inserted through a corresponding hole **54*h* in the contact retainer 46 until the flange 58 on the contact abuts the rear surface of the front plate 48 of the retainer. A pin 60 is then inserted behind the flange 58 to securely hold the contact to the retainer 46. The pin is installed deep enough that it does not project. The wire 74 is then folded to form a strain relief loop. After all of the wires and their corresponding contacts have been similarly mounted and strain relief loops formed in the wires, the tray frame 40 is slid forwardly over the wires and the retainer 46 is slid into the front end of the tray frame. Then the clamp 80 is installed on the rear of the tray frame and tightened to securely clamp the cable in place. The sheath 100 of the cable extends an inch or two forward of the clamp 80** so the clamp securely holds the sheath as well as the wires of the cable to the tray frame, while the individual separated wires extend along most of the length of the tray frame.

The assembled tray with the contacts and the cable wires in place therein is slid into the tray-passing hole 34 at the rear of the housing 20. The tray is slid all the way into the housing, with the forward portions 108 of the contacts such as 54 entering corresponding contact-receiving holes such as 27 at the front of the housing. The tray continues to be slid forward until the front surface of the front plate 48 of the retainer abuts a shoulder 110 formed at the rear of the contact-receiving holes such as 27 of the housing. The grommet 86 is then slid along the cable and pressed into the tray-passing hole 34 at the rear of the housing. The screws 92 are then inserted through the holes 94, 96 in the housing and the grommet to securely hold the grommet in place. The grommet has a pair of ridges 112, 114 that each extend completely around the grommet, to provide locations of concentrated pressure where watertight sealing is made.

The rear end portion of the housing has a pair of slits 116 extending from the rear of the housing to a location slightly forward of the screws 92. The slits permit the rear of the housing to open slightly to receive the grommet, and permit the rear of the housing to be clamped tightly around the grommet and the cable extending through the grommet. The housing forms an elongated passage 118 that receives the tray, with the passage 118 being tapered in thickness to have a progressive smaller thickness at progressively more forward locations. When the tray is fully pushed into the passage, the front of the tray is closely surrounded by the housing. Applicant has constructed and successfully tested a connector as shown in the drawings, having a length of 9½ inches and with the other dimensions proportional to the length as illustrated.

Thus, the invention provides a connector with a reliable watertight housing, which enables a cable and contacts to be installed and repaired in the field. The connector includes a tray to which unitary contacts are mounted and which surrounds the individual wires of the unsheathed cable end portion and strain relief loops of the wires, and which securely clamps to the sheathed portion of the cable. After the contacts, wires, and sheathed cable are securely mounted to the tray, the tray is inserted deep into the housing and the housing sealed closed except, of course, for the holes at the front of the housing where it receives pin contacts. By enabling connections to be made in a relatively open tray that can be inserted into a housing, the housing can be made reliably waterproof.

Although particular embodiments of the invention have been described and illustrated herein, it is recognized that modifications and variations may readily occur to those skilled in the art and consequently it is intended to cover such modifications and equivalents.

What is claimed is:

1. A connector which can be coupled to a cable having a plurality of wires and a sheath around most of the length of the wires, comprising:

a housing of insulative material having a front end forming a plurality of contact-receiving holes and a rear end forming a tray-passing hole;

a tray having an open rear end, said tray having a clamp at said rear end for clamping to said cable, said tray having a front end and a contact retainer portion at said front end forming a plurality of contact locating holes;

a plurality of contacts mountable on said retainer portion in said locating holes;

said tray being slideable fully into said housing through said tray-passing hole, said housing closely surrounding said tray with said contact locating holes aligned with said contact-receiving holes of said housing when the tray is fully in said housing;

a rear seal grommet which closely fits into said tray-passing hole and blocks said tray, said grommet having a cable-passing hole which closely passes said sheathed cable.

2. The connector described in claim 1 wherein:

each of said contacts has a front end that can project through one of said locating holes when the contact is installed in said tray, and each contact has a flange behind said front end;

said retainer portion of said tray includes a plurality of pin receiving holes positioned to lie immediately behind said flanges of said contacts when they are installed in said tray, and a plurality of pins of insulating material which can project into said pin-receiving holes and lie immediately behind said flanges of said contacts to retain the contacts in said retainer portion of said tray.

3. The connector described in claim 1 wherein:

said cable has a forward end portion devoid of its sheath and said wires are separate along said end portion, said sheath extending rearward of said end portion;

said contacts are mounted on said contact retainer portion;

said wires each have front ends connected to one of said contacts, and a strain relief looped portion lying behind said front end but within said tray, and front end of the sheathed portion of the cable lying in said tray and being clamped by said clamp to said tray rear end, said grommet mounted in said tray-passing hole of said housing and said cable sheath ending through said cable-passing hole of said grommet.

4. A connector and cable apparatus comprising:

a housing of elastomeric insulative material having a front end with a plurality of contact-receiving holes and a rear end forming a tray-receiving hole;

a tray of insulative material which includes a tray frame having open rear and front ends, a clamp at said rear end of said tray frame, and a contact retainer at said front end of said tray frame, said retainer having a plurality of contact locating holes;

a plurality of contacts each having a forward portion projecting through said locating holes of said retainer and extending forward of said retainer and into said contact-receiving holes of said housing;

a cable having a sheath and a plurality of wires, said cable having a forward portion devoid of said sheath and forming wires lying in said tray, each wire having a front end connected to one of said contacts;

said clamp of said tray being clamped to said cable;

a grommet which has an outside that closely fits into sad tray-receiving hole, said grommet having a front which substantially abuts said tray and having a cable passing hole through which said cable extends.

5. The apparatus described in claim 4 wherein:

said grommet has front and rear ends and a thickness as measured between said ends;

said housing has a pair of opposite sides and has a slit in each side extending from the extreme rear of the housing in a forward direction by a distance less than the thickness of said grommet;

means for clamping said opposite sides of said housing at said slits, to compress the housing and said grommet.

6. The apparatus described in claim 4 wherein:

said contact retainer forms a rearwardly-facing shoulder at each of said contact locating holes, and said contacts form flanges lying against said shoulders, and including a plurality of pins of insulative material lying in said contact locating holes and immediately behind flanges of said contacts.

7. The apparatus described in claim 4 wherein:

said tray is of substantially rectangular cross-section and said tray-receiving hole in the rear end of said housing is of substantially the same rectangular cross-section;

said grommet has forward and rearward ends and has outwardly-extending ridge at said forward end which closely fit into said tray-receiving hole of said housing, said grommet having a middle portion between said ends and a pair of fastener-receiving holes in said middle portion which extend substantially perpendicular to said cable;

said housing having a fastener-receiving holes aligned with said fastener-receiving holes of said grommet; and includng a pair of fasteners projecting through said fastener-receiving holes of said grommet and said housing.

8. A method for coupling the wires of a cable which has a sheath around the wires, to the contacts of a connector which includes a tray for holding the contacts, the connector including a housing with a hollow inside for holding said tray and contact-receiving holes in its front, and a grommet which has a hole and which can closely fit into a hole in the rear of said housing, comprising;

establishing forward portions of said wires free of said sheath, said wires being separated where they are free of said sheath;

projecting said cable through said grommet and through a frame of said tray, attaching said separated wires to said contacts, and bending said separated wires in strain-relief folds;

installing said contacts in holes of a retainer of said tray, with forward portions of said contacts projecting forward of said retainer, and sliding said retainer and said strain-relief folds of said wires rearwardly into said tray frame until said retainer is installed on a forward portion of said tray frame;

clamping said cable to the rear of said tray frame;

after said steps of sliding said retainer and clamping, performing the step of sliding said traya forwardly through said hole in the rear of said housing into said housing with said forward portions of said contacts slid into said contact-receiving holes at the forward portion of said housing;

sliding said grommet into said hole in the rear of said housing.

9. The method described in claim 8 wherein:

said step of installing said contacts includes projecting each of a plurality of insulative pins into a hole in said retainer and behind a flange in one of said contacts, until the pins lie deep enough in said retainer to allow the retainer to be slid into said tray frame.

* * * * *